United States Patent [19]

Zeuner

[11] Patent Number: 5,064,483

[45] Date of Patent: Nov. 12, 1991

[54] GAS GENERATING MASS

[75] Inventor: Siegfried Zeuner, Munich, Fed. Rep. of Germany

[73] Assignee: Bayern-Chemie Gesellschaft fur flugchemische Antriebe mbH, Fed. Rep. of Germany

[21] Appl. No.: 588,719

[22] Filed: Sep. 27, 1990

[30] Foreign Application Priority Data

Oct. 27, 1989 [DE] Fed. Rep. of Germany ..... 3935869

[51] Int. Cl.[5] ..... C06G 35/00

[52] U.S. Cl. ..... 149/35; 280/741

[58] Field of Search ..... 149/35; 280/741

[56] References Cited

U.S. PATENT DOCUMENTS 3,741,585 6/1973 Hendrickson et al. ..... 149/35
3,779,823 12/1973 Price et al. ..... 149/35
3,865,660 2/1975 Lundstrom ..... 149/35
4,376,002 3/1983 Utracki ..... 149/35
4,834,817 5/1989 Zeuner ..... 149/35

FOREIGN PATENT DOCUMENTS 2336853 8/1976 Fed. Rep. of Germany .

*Primary Examiner*—Stephen J. Lechert, Jr.
*Attorney, Agent, or Firm*—Evenson, Wands, Edwards, Lenahan & McKeown

[57] ABSTRACT

A gas generating mass, particularly for inflating airbags for occupant protection systems in motor vehicles, consists of an alkali azide or alkaline earth azide, sulfur in at least an amount that is stoichiometric with respect to the oxidation of the alkali metal or alkaline earth metal of the alkali azide or the alkaline earth azide, as well as, if required, a slag forming agent.

6 Claims, No Drawings

GAS GENERATING MASS

BACKGROUND AND SUMMARY OF THE INVENTION

The present invention relates to a gas generating mass, particularly for inflating airbags for occupant protection systems in motor vehicles, containing at least one alkali azide or alkaline earth azide, an oxidant in at least an amount which is stoichiometric with respect to the oxidation of the alkali metal or the alkaline earth metal of the alkali azide or the alkaline earth azide, as well as, if necessary, a slag forming agent.

Gas generating masses or propellants of this generic type are known. Presently used series-produced propellants for inflating the airbag contain an extensively oxidizing, oxygenous salt, such as potassium nitrate, or a transition-metal oxide, such as a copper oxide or iron oxide, as the oxidant.

It is also known from the U.S. Pat. No. 4,296,084 to use molybdenum disulfide as the oxidant, 4% in weight sulfur being added in order to influence the burning characteristics. The oxidizing effect of the molybdenum disulfide is based on the fact that the quadrivalent molybdenum by means of electron absorption is transformed to zerovalent metallic molybdenum, while the sulfide anion of the molybdenum sulfide is bound as sodium sulfide, and thus the oxidation number of the sulfide (-II) is not changed. In the known gas generating mass, the molybdenum sulfide content is underbalanced so that sodium metal is formed. On the other hand, if the molybdenum sulfide content is increased, the gas yield is insufficient.

Although overall the series-produced propellants have proven themselves in practice, they must still be improved. Thus, although a high burning temperature is necessary in order to obtain the gas volume required for the inflating of the airbag with an amount of propellant that is as low as possible, the burning temperature is so high at times that additional measures must be taken to prevent excessive thermal stress to the generator housing which is generally made of aluminum. The temperature of the generated gas must also not be so high that the used ba material suffers.

It is also desirable to further increase the gas yield relative to the weight of the mass. In addition, in the case of the known propellants, expensive measures must sometimes be taken in order to prevent the escape of alkali metal oxides from the airbag which, on the one hand, result in an undesirable smoke formation and, on the other hand, have a highly caustic toxic effect.

It is therefore an object of the invention to provide a gas generating mass, particularly for an airbag gas generator which, without any excessive thermal stressing of the ga generator housing or bag material, in a relatively small amount, ensures perfect inflation of the airbag, in which case expensive measures for preventing the emerging of alkali oxides are not necessary.

This and other objects ar achieved according to the invention by the use of elementary sulfur a the oxidant in the gas generating mass a described in detail herein.

By means of the mass according to the invention, a sufficiently low burning temperature may be achieved because the heat of formation of the forming sodium sulfide as well as the additional energy gain by mean of the reaction with the slag forming agent is lower than in the case of sodium oxide which, in the series produced propellants, is formed by the oxygenous salt, such as potassium nitrate, or the transition-metal oxides, such as iron oxide or copper oxide, contained in them. In addition, the gas yield, relative to the weight of the mass, is larger in the cas of the mass according to the invention than in the case of the known propellants because the oxidant (sulfur) forms no inert materials, such as potassium oxide which is formed from the potassium cation of the potassium nitrate, iron or copper which is formed from the transition-metal oxides of the known series-produced propellants, or metallic molybdenum which is formed from the molybdenum disulfide of the mass according to U.S. Pat. No. 4,296,084.

The mass according to the invention also requires considerably lower expenditures to prevent the escape of alkali I5 oxide or alkaline earth oxide from the generator.

As was determined by experiments using sodium azide as the alkali azide, by means of the mass according to the invention, the formation of sodium oxide is reduced by the factor 5 to 10 in comparison to the series-produced mass with potassium nitrate as the oxidant, and is therefore almost completely eliminated. This is probably the result of the fact that, in the case of the known propellant, the sodium oxide in the formed liquid slag disintegrates in a small amount, because of the high burning temperature, to metallic sodium which evaporates and, in the gaseous phase, because of the reaction with the oxygen of the air, forms very fine sodium oxide particles.

Since the burning temperature is lower in the case of the mass according to the invention, the formation of metallic sodium is reduced correspondingly. In addition, in the case of the mass according to the invention, at burning temperatures which although they are lower, are still generally well above 1,000° C., the sulfur reacts at least partially in the gaseous condition so that it immediately binds possible evaporated metallic sodium as sodium sulfide.

Other objects, advantages and novel features of the present invention will become apparent from the following detailed description of the invention.

DETAILED DESCRIPTION OF THE INVENTION

The gas generating mass according to the invention may consist only of the alkali azide or the alkaline earth azide as well as of sulfur as the oxidant. In order to bind all solid burning products, and thus prevent the escape of particles from the airbag, preferably a slag forming agent is also added to the mass. In this case, the slag forming agent may be a glass forming oxide, such as silicon oxide ($SiO_2$), aluminum oxide ($Al_2O_3$) or boron oxide ($B_2O_3$). Sodium azide is preferably used as the azide.

If sodium azide and silicon oxide are used as the slag forming agents, the mass according to the invention reacts according to the following reaction equation:

$$\text{(I)}\ 10\ NaN_3 + x\ SiO_2 + 5\ S \rightarrow 5\ Na_2S \cdot x\ SiO_2 + N_2 \qquad (1)$$

In this case, the amount of the silicon oxide is selected such that, on the one hand, the amount of the slag (and thus its capacity to bind the solid burning products) is sufficient, while, on the other hand, a reduction of the silicon oxide part causes an increase of the gas yield relative to the weight of the mass. Generally therefore, the mol value of the silicon oxide, thus x in equation (I), amounts to 3–5, preferably 4–5.

It is also advantageous to use the sulfur in slight excess, i.e., to use 5–6 mol (gram-atoms) sulfur instead of 5 mol (gram-atoms) of sulfur according to equation (I) because due to the excess sulfur, the formation of metallic sodium is reduced by the integration of the $Na_2S$-part of the slag ($Na_2 \cdot x\ SiO_2$).

Thus the following preferred ratios of weight in percent by weight are obtained for a mass according to the invention I5 consisting of sodium azide, silicon oxide and sulfur: 56 to 66% sodium azide, 18 to 27, preferably 22 to 27% silicon oxide and 14 to 17% sulfur.

If, instead of silicon oxide ($SiO_2$), aluminum oxide ($Al_2C_3$), for example, is used as the slag forming agent, its proportion amounts to preferably 3/2 to 5/2 mol per 10 mol of sodium azide; i.e., the ratio of the glass forming agent to 10 mol alkali azide or 5 mol alkaline earth azide, is preferably 3 to 5 mol, divided by the number of the metal atoms or silicon atoms in the molecule (at $SiO_2=1$ or $AlC_2O_3=2$).

Instead of the glass-forming oxides, in the case of the mass according to the invention, nitrides can also be used advantageously as slag forming agents, particularly boron nitride (BN), aluminum nitride (AlN), silicon nitride ($Si_3N_4$) as well as transition-metal nitrides or nitrides of other metals.

From these nitrides, solid sintered substances are obtained which also prevent the escape of particles from the airbag. In addition, particularly boron nitride, aluminum nitride and silicon nitride have a relatively low molecular weight so that the gas yield is high relative to the weight of the mass.

When sodium azide is used with boron nitride as the slag forming agent, the mass according to the invention reacts according to the following reaction equation:

$$\text{(II)}\ 10\ NaN_3 + x\ BN + 5\ S \rightarrow 5\ Na_2S \cdot x\ BN + N_2 \qquad \text{(II)}$$

In this case, the BN, under the drastic reaction conditions, partially separates gaseous nitrogen. This means that, in addition to the BN, other nitrides, such as $B_2N$, are also contained in the slag. This results in another advantage of the use of nitrides which is that the gas yield experiences an additional increase.

As explained above in connection with the reaction equation (I), also when BN is used, the mol value, thus x in equation (II), is preferably 3 to 5, particularly 4 to 5, relative to 10 mol alkali azide or 5 mol alkaline earth azide. In addition, it is also advantageous in the case of the mass reacting according to equation (II) to use the sulfur at a slight excess, thus 5 to 6 mol (gram-atoms) of sulfur instead of 5 mol (gram-atoms) of sulfur, as indicated in equation (II).

Thus the following preferred ratios of weight in percent by weight are obtained for a mass according to the invention consisting of sodium azide, boron nitride and sulfur: 67 to 74% sodium azide, 8 to 14 % boron nitride and 18 to 20% sulfur.

If, instead of boron nitride (BN), for example, silicon nitride ($Si_3N_4$) is used as the slag forming agent, its proportion is 1 to 5/3 mol per 10 mol of sodium azide; i.e., 3 to 5 mol, divided by the number of the metal atoms or silicon atoms in the molecule (in the case of $BN=1$ or in the case of $Si_3N_4=3$).

The following examples provide a further explanation of the invention.

The following mixtures were prepared:

Mixture A:

61.9 percent in weight sodium azide
15.2 percent in weight elementary sulfur
22.9 percent in weight silicon oxide Mixture B:

69.6 percent in weight sodium azide
17.1 percent in weight elementary sulfur
13.3 percent in weight boron nitride Mixture C:

56.4 percent in weight sodium azide
18.6 percent in weight potassium nitrate
26.0 percent in weight silicon oxide.

In this case, mixtures A and B correspond to the invention while, for purposes of a comparison, mixture C represents the mixture for a series-produced propellant.

Pellets were pressed from mixtures A, B and C respectively and were burned in a series-produced generator. In each case, the surface temperature of the generator was determined after the burning and the ejection of particles was measured. The results are listed in the following table.

As indicated in the table, the pellets made from mixtures A and B during the burning result in a clearly lower surface temperature of the generator than the pellets made from mixture C. In addition, in the case of the pellets made from mixtures A and B, a lower ejection of particles was determined than in the case of the pellets made from mixture C, and particularly in the case of mixture B, a higher gas yield was obtained.

| Mixture | Burning Temperature [°C.] | Surface Temperature of Generator [°C.] | Particle Ejection [mg] | Gas Yield [NL/g] |
|---|---|---|---|---|
| A | 1,363 | 289 | 95 | 0.32 |
| B | 1,611 | 300 | 475 | 0.36 |
| C | 1,930 | 340 | 670 | 0.31 |

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A gas generating mass, particularly for inflating airbags for occupant protection systems in motor vehicles, containing at least one alkali azide or alkaline earth azide, an oxidant in at least an amount which is stoichiometric with respect to the oxidation of the alkali metal or the alkaline earth metal of the alkali azide or the alkaline earth azide, as well as a slag forming agent, wherein the oxidant consists exclusively of elementary sulfur, and wherein the ratio of the slag forming agent to the alkali azide or alkaline earth azide is 3–5, divided by the number of the metal atoms or silicon atoms or boron atoms in the molecule of the slag forming agent to 10 mol alkali azide or 5 mol alkaline earth azide.

2. The mass according to claim 1, wherein the ratio of the alkali azide or alkaline earth azide to the sulfur is 10 mol alkali azide or 5 mol alkaline earth azide to 5 to 6 mol of sulfur.

3. The mass according to claim 1, wherein the slag forming agent is a glass forming oxide.

4. The mass according to claim 3, wherein the glass forming oxide is silicon oxide, aluminum oxide and/or boron oxide.

5. The mass according to claim 1, wherein the slag forming agent is at least one of: boron nitride, aluminum nitride, silicon nitride and a transition-metal nitride.

6. A gas generating mass according to claim 1, wherein the ratio of the slag forming agent to the alkali azide or alkali earth azide is 4–5.

* * * * *